US009435548B2

(12) United States Patent
Koo et al.

(10) Patent No.: US 9,435,548 B2
(45) Date of Patent: Sep. 6, 2016

(54) OUTDOOR UNIT OF AIR CONDITIONER AND METHOD FOR CONTROLLING THE SAME

(75) Inventors: Jahyung Koo, Seoul (KR); Byungil Park, Seoul (KR); Kyongmin Kwon, Seoul (KR); Byungsoon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 965 days.

(21) Appl. No.: 13/426,957

(22) Filed: Mar. 22, 2012

(65) Prior Publication Data

US 2012/0247136 A1 Oct. 4, 2012

(30) Foreign Application Priority Data

Mar. 28, 2011 (KR) ..... 10-2011-0027397

(51) Int. Cl.

| | |
|---|---|
| ***F25D 21/00*** | (2006.01) |
| ***F25D 21/12*** | (2006.01) |
| ***F25B 49/00*** | (2006.01) |
| ***F25D 21/06*** | (2006.01) |
| ***F25D 21/10*** | (2006.01) |
| ***F25D 21/14*** | (2006.01) |
| ***F24F 1/06*** | (2011.01) |
| ***F24F 1/14*** | (2011.01) |
| *F24F 5/00* | (2006.01) |
| *F24F 11/00* | (2006.01) |

(52) U.S. Cl.

CPC . *F24F 1/06* (2013.01); *F24F 1/14* (2013.01); *F25D 21/10* (2013.01); *F24F 2005/0025* (2013.01); *F24F 2011/0089* (2013.01); *F25B 2347/02* (2013.01); *F25B 2347/021* (2013.01); *F25D 21/06* (2013.01); *F25D 21/14* (2013.01)

(58) Field of Classification Search

CPC .... F25D 21/00; F25D 21/002; F25D 21/006; F25D 21/008; F25D 21/10; F25D 2321/146; F25D 21/06; F25D 21/14; F25B 2700/11; F25B 2339/021; F25B 47/006; F25B 2347/02; F25B 2347/021

USPC ..... 62/82, 282, 165, 80, 125, 127, 150, 62/151, 155, 272, 288, 291

See application file for complete search history.

(56) References Cited

U.S. PATENT DOCUMENTS

| | | | | |
|---|---|---|---|---|
| 3,169,381 | A * | 2/1965 | Persson | 62/57 |
| 3,854,302 | A * | 12/1974 | Masuda | 62/282 |
| 3,875,758 | A * | 4/1975 | Fischer | 62/157 |
| 4,395,887 | A * | 8/1983 | Sweetman | 62/155 |

FOREIGN PATENT DOCUMENTS

| | | |
|---|---|---|
| CN | 2526757 | 12/2002 |
| CN | 201074934 | 6/2008 |
| CN | 101451779 | 6/2009 |
| CN | 101469926 | 7/2009 |
| CN | 101551183 | 10/2009 |
| CN | 201513990 | 6/2010 |
| JP | 2001-021241 | 1/2001 |

OTHER PUBLICATIONS

Chinese Office Action dated Dec. 31, 2013. (translation).

* cited by examiner

*Primary Examiner* — M. Alexandra Elve
*Assistant Examiner* — Daniel C Comings
(74) *Attorney, Agent, or Firm* — Ked & Associates LLP

(57) ABSTRACT

An outdoor unit for an air conditioning system includes a tank to store defrosting liquid, a nozzle to apply defrosting liquid from the tank to a heat exchanger, a valve to control flow of the defrosting liquid between the tank and nozzle, and a controller to control the valve based on a temperature of the heat exchanger and a number of times the valve has been set to an open state during a heating mode of the air conditioning system.

12 Claims, 6 Drawing Sheets

Fig. 5

| TIMER TIME INTEGRATION | EVAPORATION TEMPERATURE $\leq T_1$ | $T_1$ <EVAPORATION TEMPERATURE $\leq T_2$ | $T_2$ <EVAPORATION TEMPERATURE $\leq$ SET TEMPERATURE |
|---|---|---|---|
| INJECTION VALVE | | | |
| ON/OFF | ON : 5MINUTE | ON : 3MINUTE | ON : 2MINUTE |
| SECTION | OFF : 5MINUTE | OFF : 7MINUTE | OFF : 8MINUTE |
| (INJECTION PERIOD/NUMBER) | n = 6 | n = 6 | n = 5 |

OUTDOOR UNIT OF AIR CONDITIONER AND METHOD FOR CONTROLLING THE SAME

The present application claims priority under 35 U.S.C. §119 and 35 U.S.C. §365 to Korean Patent Application No. 10-2011-0027397 filed on Mar. 28, 2011, which is incorporated herein by reference.

BACKGROUND

1. Field

One or more embodiments described herein relate to an air conditioner.

2. Background

Air conditioners cool and heat based on a refrigerant cycle. When the cycle is set to perform a cooling operation, an outdoor heat exchanger serves as a condenser and an indoor heat exchanger serves as an evaporator. Conversely, when the cycle is set to perform a heating operation, the indoor heat exchanger serves as the condenser and the outdoor heat exchanger serves as the evaporator. During these operations, the formation of frost and/or other hindrances tend to reduce efficiency.

BRIEF DESCRIPTION OF THE DRAWINGS

FIG. 5 shows operational parameters and conditions of the air conditioner.

DETAILED DESCRIPTION

Figure 1:
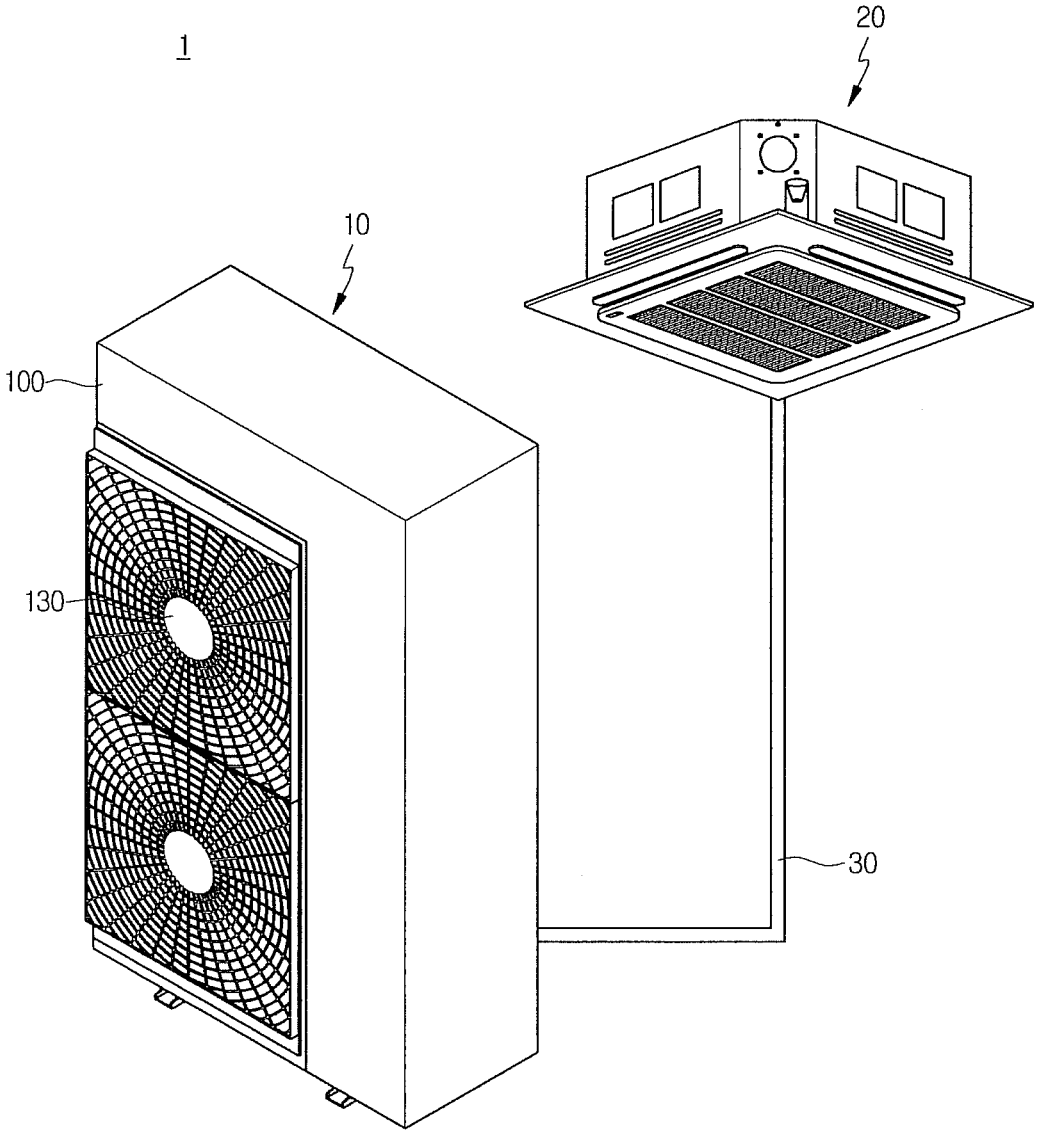
FIG. 1 shows one embodiment of an air conditioner.

FIG. 1 shows a first embodiment of an air conditioner which includes a connection tube or conduit 30 between an outdoor unit 10 and indoor unit 20. The outdoor unit 10 includes a case 100 having a plurality of built-in parts, a suction grill for receiving outdoor air, and a discharge grill 130 for discharging the air after a heat-exchange operation is performed. One or multiple grills may be included.

Figure 2:
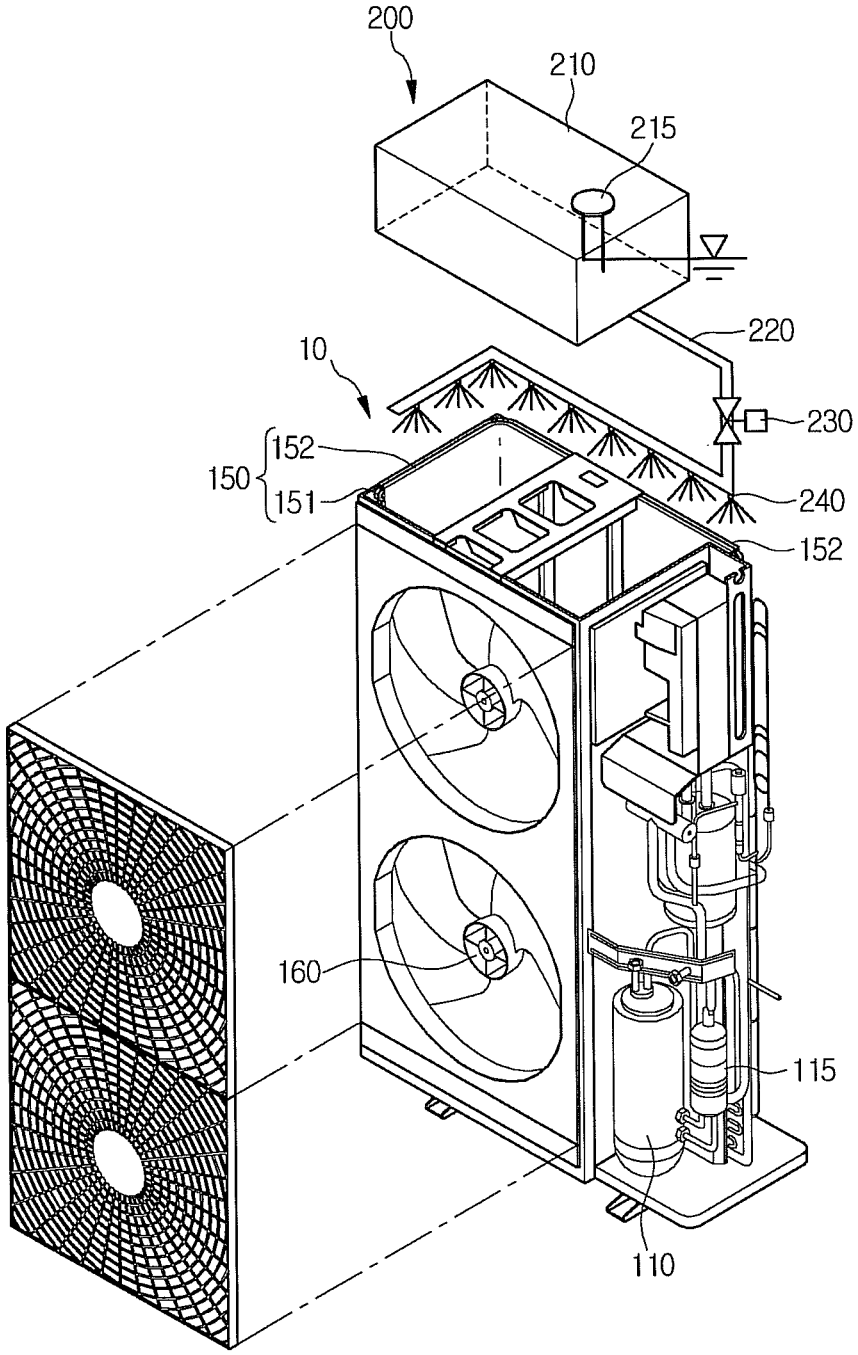
FIG. 2 shows inner components of an outdoor unit of the air conditioner.

FIG. 2 shows that the outdoor unit may include a compressor 110 for compressing a refrigerant, a gas/liquid separator 115 for filtering a liquid refrigerant from the refrigerant introduced into the compressor, an outdoor heat exchanger 150 that includes a refrigerant tube 151 and an arrangement of one or more heat exchange fins 152, and a fan for blowing external air into the outdoor heat exchanger. The refrigerant tube carries the refrigerant and the heat exchange fin(s) increase heat exchange performance between external air and the refrigerant. The refrigerant tube 151 may pass through the heat exchange fins) 152, or the tube may be coupled to or otherwise placed in relation to the fin(s).

The tube and/or fin(s) of the outdoor heat exchanger 150 may extend in a length direction of the case 100 from an upper side of the case 100 up to a lower side of the case. Also, the tube and/or fin(s) of the outdoor heat exchanger may be bent, for example, in a "┐" shape or another shape, from a rear surface of the case up to a side surface of the case. In other embodiments, the tube and fin(s) may be provided in other configurations.

The fan 160 may be disposed at a rear side of discharge grill 130. In one embodiment, multiple fans are provided, for example, on upper and lower portions of the case 100. Only one discharge grill may be provided for multiple fans or separate discharge grills may be provided for each fan. According to another embodiment, one fan and one discharge grill may be provided based on a length or placement of the tube 151 and/or fin(s) 152 of the outdoor heat exchanger.

An injection device 200, for injecting a defrosting liquid toward the outdoor heat exchanger, may be disposed above or adjacent to the tube and fin(s) of the outdoor heat exchanger. The injection device may include a storage tank 210 for storing the defrosting liquid and a water level sensor 215 within the storage tank to detect a level of the defrosting liquid in the storage tank.

The storage tank 210 may be supported on the inside of case 210 and may be disposed above or adjacent the outdoor heat exchanger. The water level sensor 215 may detect a level of the defrosting liquid when the level of the defrosting liquid is below a predetermined level.

The injection device 200 further includes an injection tube 220 providing a moving path of the defrosting liquid discharged from the storage tank 210, at least one nozzle disposed on one end of the injection tube 220 to inject the defrosting liquid toward the outdoor heat exchanger, and an injection valve 230 having an adjustable ON/OFF or opening degree to control the injection of the defrosting liquid in the nozzle part 240.

The injection tube 220 may extend downward or otherwise from the storage tank 210, and the injection valve 230 may be disposed at a predetermined position of the injection tube. For convenience purposes, a portion of the injection tube extending from the storage tank may be referred to as an upper portion (or first portion), and a portion extending from the nozzle part 240 may be referred to as a lower portion (or second portion) with respect to injection valve 230.

In one embodiment, a plurality of nozzle parts 240 may be provided below or coupled to the injection tube 220. In this arrangement, the nozzle parts may be spaced from each other and, for example, may have an approximately "┐" shape or other shape that corresponds to the shape of the outdoor heat exchanger 150. At least one of the storage tank 210 or the nozzle parts(s) 240 may be above the outdoor heat exchanger 150.

The defrosting liquid may be a solution having a very low freezing temperature. When the defrosting liquid reacts with frost on the outdoor heat exchanger, a freezing point lowering effect may occur to melt the frost. The defrosting liquid may be, for example, a non-chloride-based organic or non-organic complex and may include potassium acetate (CH3COOK) or potassium carbonate (K2CO3). The defrosting liquid may not be frozen at least 30° below zero, and may maintain a liquid state at maximum 50° below zero according to its concentration. In other embodiments, a different defrosting liquid may be used with different temperature parameters.

In operation, when the air conditioner is set to perform in a heating mode, the outdoor heat exchanger 150 performs a heat-exchange operation with external air to evaporate the refrigerant. Here, when an operation condition of the defrosting liquid injection device 200 is recognized, injection valve 230 may be opened or closed for a predetermined period.

When injection valve 230 is opened (in the ON state), the defrosting liquid in the storage tank 210 is moved to the nozzle part 240 through injection tube 220. Then, the defrosting liquid is injected onto the outdoor heat exchanger 150 through one or more openings (or nozzles) in the nozzle part 240. The injected defrosting liquid descends along refrigerant tube 151 and/or heat exchange fin(s) 152 to melt the frost formed on at least these parts of the heat exchanger.

Figure 3:
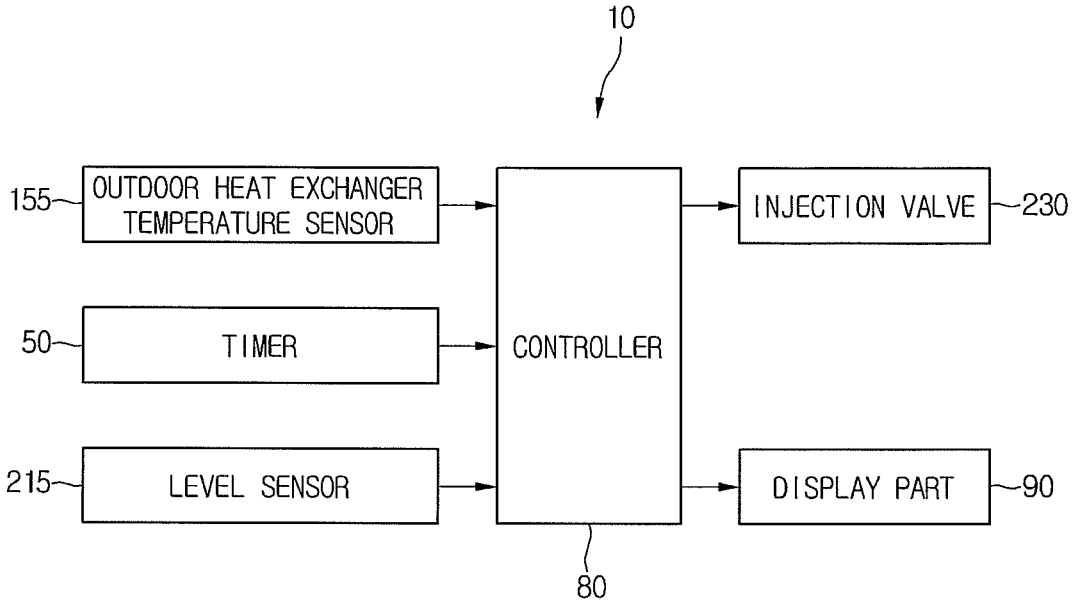
FIG. 3 shows components of the outdoor unit.

FIG. 3 shows a block diagram of the outdoor unit. As shown, outdoor unit 10 includes an outdoor heat exchanger temperature sensor 155 for detecting a temperature of a refrigerant outlet, an external temperature, or other temperature of an outdoor heat exchanger, a timer 50 for counting a time elapsed from a predetermined reference time point, a level sensor 215 disposed within a storage tank 210 to detect a level of a defrosting liquid, and a controller 80 for controlling operation of the outdoor unit based on info nation recognized from or derived by the aforementioned components.

A value detected by the outdoor heat exchanger temperature sensor 155 may be or provide an indication of an evaporating temperature of the outdoor heat exchanger 150. The timer 50 may integrate or count the elapsed time using an operation starting time point of the air conditioner or outdoor unit 10 as a reference time point. For example, the reference time point may be understood as a time point at which an operation command of the air conditioner is input in indoor unit 20 or a time point at which operation of compressor 110 begins. In other embodiments, a different reference time point may be used.

When a level of the defrosting liquid is below a preset level, the level sensor 215 may detect this condition and transfer the detected level value to the controller 80.

The outdoor unit 10 includes the injection valve 230, which has an adjustable opening degree to inject the defrosting liquid from storage tank 210 toward outdoor heat exchanger 150 and a display part for displaying a supplement, level, or remaining portion of the defrosting liquid when a level of the defrosting liquid in the storage tank is below a preset level.

When defrosting liquid injection for removing frost from surfaces of the outdoor heat exchanger 150 is decided, controller 80 opens injection valve 230 to supply the defrosting liquid from storage tank 210 to nozzle part 240. The defrosting liquid discharged from the nozzle part flows along at least one portion of the outdoor heat exchanger tube 151 and/or fins) 152. When the defrosting liquid flows, frost formed on these portions of the outdoor heat exchanger may react with the defrosting liquid to melt.

The injection valve 230 may transition between an ON (at least a partially open) state or an OFF (at least substantially closed) state, and the opening degree of the valve may be controlled (by the controller or other processor) to adjust a supply amount (injection amount) of the defrosting liquid. Moreover, the injection valve may be opened or closed based on a time integrated, counted, or otherwise determined by timer 50. That is, adjustment of the opening degree of the injection valve may be controlled according to a time elapsing from a predetermined reference time point.

The display part 90 may display contents including information indicating that the defrosting liquid in the storage tank is insufficient and/or approaching an insufficient level, and/or may display a request for filling or otherwise replenishing the defrosting liquid. This and other information may be displayed, for example, through text and/or graphics (e.g., characters, colors, or blinking), audibly (e.g., speaker), video, or a combination of these.

Although the display part 90 is shown to be provided on the outdoor unit 10 in the current embodiment, the display part may be disposed on the indoor unit 20 in alternative embodiments to allow, for example, a user to more easily recognize information regarding the maintenance and operation of the air conditioner and/or its various parts.

Figure 4:
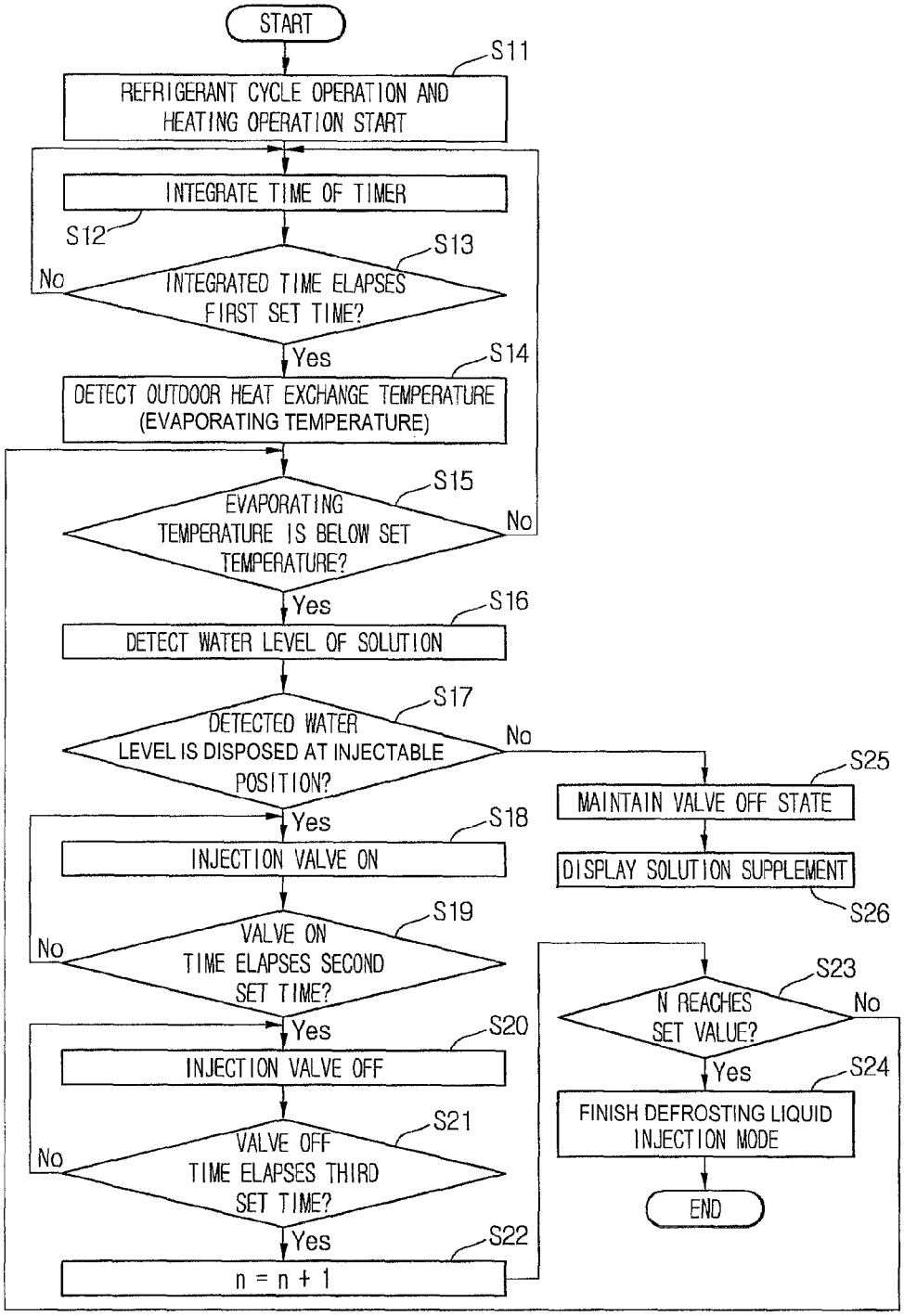
FIG. 4 shows one embodiment of a method for controlling an air conditioner.

FIG. 4 shows one embodiment of a method for controlling an air conditioner including an outdoor unit. The outdoor unit may be the one described in accordance with the previous embodiments or may be another type of air conditioner.

When an operation command of the air conditioner is received, a refrigerant cycle may be set to heating mode for an indoor space. Here, in operation S11, the outdoor heat exchanger may serve as an evaporator and an indoor heat exchanger disposed in the indoor unit may serve as a condenser.

When the heating mode starts, a time elapsed from a predetermined reference time point is counted or integrated. In operation S12, the reference time point may be, for example, a time point at which or based on when the operation command of the air conditioner is received or initiated or at which or based on a time point at which operation of compressor 110 starts.

A determination is then made as to whether the elapsed time corresponds to a first predetermined time, which corresponds to a time period required for stabilizing the refrigerant cycle. In operation S13, when the first predetermined time is reached, an evaporating temperature of the refrigerant cycle may be relatively accurately detected. The evaporating temperature may correspond, for example, to a refrigerant temperature of or at an outlet of the outdoor heat exchanger 150. In operation S14, the evaporating temperature may be detected by outdoor heat exchanger temperature sensor 155.

A determination is also made as to whether the evaporating temperature is below a set temperature. The set temperature may be, for example, a reference temperature for determining whether the defrosting liquid can be injected from the injection device 200. The set temperature may be variously set, for example, according to a temperature of air proximate the outdoor unit. For example, when the temperature of this air is relatively low, the set temperature may be decided to have a relatively low temperature.

When the evaporating temperature is less than the set temperature, a control operation for the injection device 200 is performed. This operation may include entering a defrosting liquid injection mode inrushing. In operation S16, a level of the defrosting liquid stored in the storage tank 210 may be detected.

When it is detected that the evaporating temperature exceeds the set temperature, the process returns to operation S12. Then, an integration or counted time of the timer is reset and an elapsed time is integrated or counted again.

In operation S17, as determination is made as to whether the level of the defrosting liquid corresponds to an injectable position. If the level is at an injectable position, this may be recognized as a state in which the defrosting liquid is sufficiently stored. Thus, in operation S18, the injection valve 230 is switched to the ON state to inject the defrosting liquid toward the outdoor heat exchanger 150 through the nozzle part 240.

The time during which the injection valve 230 in the ON state is integrated or counted. Then, a determination is made as to whether the counted or integrated time that has elapsed corresponds to a second predetermined time. The second predetermined time may be a variable for deciding an injection period of the defrosting liquid. In operation S19, the second predetermined time may be decided as a different value according to a range of the evaporating temperature.

If the time during which the valve is in the ON state corresponds to the second predetermined time, the injection valve may be switched to an OFF state in operation S20.

The time during which the injection valve 230 is in the OFF state is integrated or counted. A determination is then made as to whether this counted or integrated time corresponds to a third predetermined time. The third predetermined time may be variable for deciding an injection period of the defrosting liquid. In operation S21, the third predetermined time may be decided as a different value, for example, according to the range of the evaporating temperature.

If the time injection valve 230 is in the OFF state corresponds to the third predetermined time, the injection number of injection valve 200 may be counted once (n=n+1). That is, given an initial value of n=0, the injection number is counted as n=1 after the defrosting liquid is injected. Then, whenever the injection operation is performed, the injection number may be counted as n=2, 3, 4, . . . .

In accordance with one embodiment, the injection operation (mode) of the nozzle part 240 (which involves opening and closing of the injection valve) may be repeatedly performed, e.g., at least two times. The repetition number of the injection operation may be determined based on how many times injection valve 230 is switched to the ON state. For example, when the injection valve 230 switches from the ON state, to the OFF state, and to the ON state again, the repetition number may be two.

In one embodiment, the injection operation of nozzle part 240 may be performed only once according to the amount of frost formed on the outdoor heat exchanger 150. In other embodiments, the injection operation may be performed multiple times under these conditions.

After the counting operation is performed, it is determined whether the repetition value (n) reaches a predetermined value. This predetermined value may be a value related to the number of injection operations of the injection device 200. This value may be different, set, or varied according to the range of the evaporating temperature.

When the counted number reaches the predetermined value, the defrosting liquid injection mode is completed in operation S24. If the counted number has not yet reached the predetermined value, the process returns to the operation S15 and then the defrosting liquid injection operation is repeatedly performed.

FIG. 5 shows an example of operating parameters and conditions for controlling an air conditioner. As shown, an ON/OFF section of the injection valve 230 is based on ranges of the temperatures, and for each range there are associated injection periods and numbers of the defrosting liquid.

The evaporating temperature range may be divided based on predetermined temperature values T1 and T2, and the injection period and number may be decided according to the divided ranges. The predetermined temperature values T1 and T2 may be less than a reference temperature (e.g., the predetermined temperature in FIG. 4) at which the defrosting liquid can be injected. Temperature T1 may be greater than the temperature T2.

For example, when the evaporating temperature is greater than temperature T2 and less than the predetermined or reference temperature, the ON time of the injection valve 230 may be about 2 minutes, the OFF time may be about 8 minutes, and the injection number may be set 5 times. That is, the injection valve 230 may be opened at an interval of about 8 minutes and for about 2 minutes. This process may be repeatedly performed 5 times.

On the other hand, when the evaporating temperature is greater than temperature T1 and less than temperature T2, the ON time of the injection valve 230 may be about 3 minutes, the OFF time may be about 7 minutes, and the injection number may be set 6 times. That is, the injection valve 230 may be opened at an interval of about 7 minutes and for about 3 minutes. This process may be repeatedly performed 6 times.

When the evaporating temperature is less than temperature T1, the ON time of the injection valve 230 may be about 5 minutes, the OFF time may be about 5 minutes, and the injection number may be set 6 times. That is, the injection valve 230 may be opened at an interval of about 5 minutes and for about 5 minutes. This process may be repeatedly performed 6 times.

As described above, when the evaporating temperature is less than the predetermined time, the possibility of the frost formation on the outdoor heat exchanger may be increased. Thus, the injection period of injection valve 230 may be reduced more and more and the injection number of the injection valve may be increased more and more.

The values and temperature ranges in FIG. 5 are illustrative of only one embodiment. In other embodiments, the values and temperature ranges may vary or be different based on the capacity of the indoor or outdoor units, external air temperature, or other conditions or system requirements.

When the level detected in the operation S17 is lower than the injectable position, a state in which the defrosting liquid is insufficient is detected. Thus, in operation S25, the injection valve 230 may be switched to or maintained in the OFF state.

Then, display part 90 may display information indicating that the defrosting liquid should be filled to storage tank 210. In operation S26, the user or manager may confirm the displayed content to separate the storage tank 210 from the outdoor unit 10, yo thereby fill the storage tank 210 with more defrosting liquid.

In accordance with one or more of the aforementioned embodiments, because the defrosting liquid is injected to remove the frost on the outdoor heat exchanger, a reverse cycle or the passing of high pressure gas through a compressor for injection into an evaporator may be omitted. In addition, the defrosting time may be reduced and the heating operation time may be extended.

Also, because the injection period and number of the defrosting liquid may be controlled according to the evaporating temperature and the range of the external air temperature, unnecessary defrosting liquid injection may be prevented and power consumption may be reduced.

Also, because the defrosting liquid injection or filling is performed according to the level of the defrosting liquid in the storage tank, convenience of use may be improved.

Figure 6:
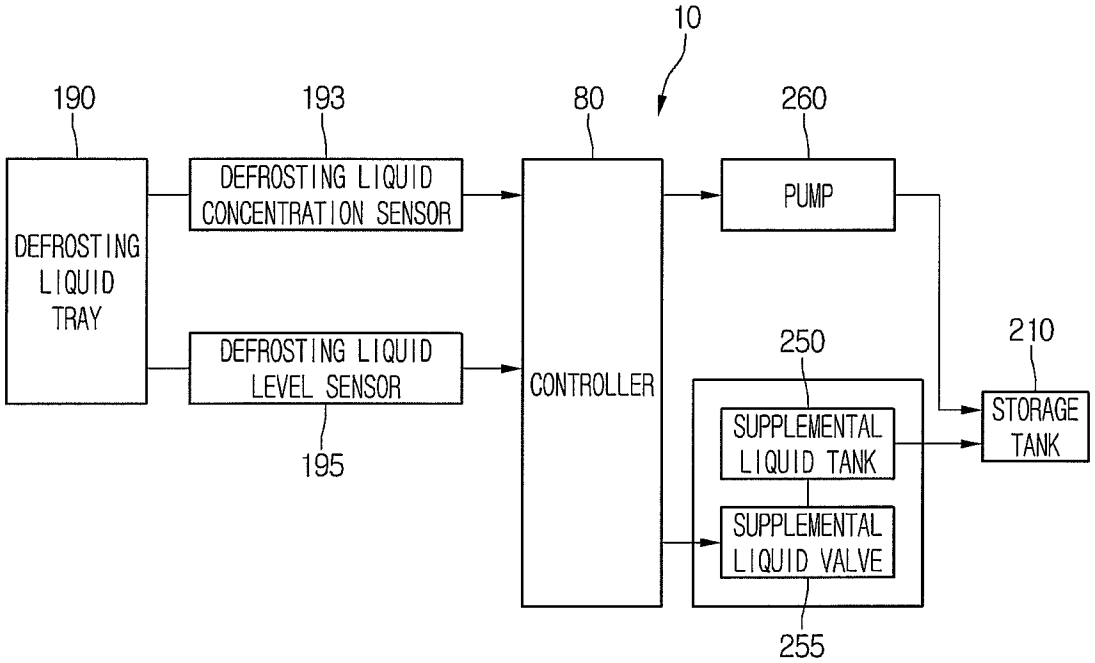
FIG. 6 shows a second embodiment of an outdoor unit of an air conditioner.

FIG. 6 shows a second embodiment of an outdoor unit 10 of an air conditioner. Where applicable, like reference numerals are used to denote like features. As shown, the second embodiment of the outdoor unit includes a defrosting liquid tray 190 for collecting a defrosting liquid that reacts with an outer heat exchanger 150 to melt frost. The defrosting liquid tray may be disposed at lower side of the outdoor heat exchanger.

Because the defrosting liquid and water from the melted frost are collected in the defrosting liquid tray, the defrosting liquid collected into the tray may have a concentration (thin) less than that of the defrosting liquid in storage tank 210.

The defrosting liquid tray may have a defrosting liquid concentration sensor 193 for detecting a concentration of the defrosting liquid and a defrosting liquid level sensor 195 for detecting a level of the defrosting liquid. The defrosting liquid concentration sensor 193 may measure a concentration of the defrosting liquid using a current variation.

The information detected by the defrosting liquid concentration sensor 193 and defrosting liquid level sensor 195 may be transmitted to a controller 80. The controller may decide a period or amount required for filling the defrosting liquid to the storage tank.

The outdoor unit 10 may includes a pump 260 for pumping the defrosting liquid stored in the defrosting liquid tray 190 into the storage tank 210, a supplemental liquid tank 250 for storing the defrosting liquid (supplemental liquid) to be supplied into the storage tank 210, and a supplemental liquid valve 255 having an adjustable opening degree to supply the supplemental liquid into the storage tank 210. The supplemental liquid valve may be disposed in a liquid tube coupling storage tank 210 to the supplemental liquid tank 250.

When a water level of the defrosting liquid, which is greater than a predetermined water level, is detected by the defrosting liquid level sensor 195, the pump 260 is operated to pump the defrosting liquid into the storage tank 210 from the defrosting liquid tray 190 disposed at a position lower than that of the storage tank 210. Thus, it may prevent the defrosting liquid from overflowing from the defrosting liquid tray 190.

Also, it may be determined an amount of defrosting liquid in the storage tank and/or an amount of defrosting liquid that needs to be replenished in order to fill the tank. This, or these amounts, may be determined based on the concentration detected by the defrosting liquid concentration sensor 193. When the detected concentration of the defrosting liquid is less than a predetermined concentration, a controller 80 may recognize whether there is an adequate amount of defrosting liquid in the tank or whether additional defrosting liquid must be added.

The controller 80 may adjust an opening degree of the supplemental liquid valve 255 based on the determined amount of defrosting liquid. The supplemental liquid valve 255 may be completely opened or partially opened in this regard.

When the supplemental liquid valve 255 is opened, the supplemental liquid may be introduced from the supplemental liquid tank 250 into the storage tank 210. When the decided amount of the supplemental liquid is completely introduced, the supplemental liquid valve 255 may be closed.

Thus, the defrosting liquid introduced into storage tank 210 from the defrosting liquid tray 190 by the pump 260 and the supplemental liquid introduced from the supplemental liquid tank 250 may be mixed with each other to form the defrosting liquid having a desired concentration.

According to at least one embodiment, frost formed on the outdoor heat exchanger may be removed or generation of frost on the outdoor heat exchanger may be delayed. Thus, heat exchange efficiency of the outdoor heat exchanger may be improved to increase heating capacity.

Also, because the defrosting operation and heating operation may be performed at the same time, a separate defrosting operation may be omitted or reduced in time. Thus, the heating operation time may be extended.

Also, because the defrosting liquid injection device for removing frost on the outdoor heat exchanger has a simple structure, the defrosting liquid injection device may be easily installed in the outdoor unit to reduce manufacturing costs.

Also, because the defrosting liquid injection period may be adjusted according to a range of the evaporating temperature in the outdoor heat exchanger, a consumption amount of defrosting liquid required for removing frost may be adequately controlled. Therefore, power consumption for operating the defrosting liquid injection device may be reduced. Also, because the defrosting liquid may be repeatedly reused, usage efficiency of the defrosting liquid may be improved.

In accordance with one embodiment, an outdoor unit including an outdoor heat exchanger for evaporating a refrigerant according to a heating operation mode of an air conditioner, the outdoor unit including: a storage tank disposed on a side of the outdoor heat exchanger, the storage tank storing a defrosting liquid reacting with frosts generated on the outdoor heat exchanger; a nozzle part for supplying the defrosting liquid from the storage tank to the outdoor heat exchanger; a timer for integrating a time elapsing from a reference time to decide a supply time of the defrosting liquid supplied from the storage tank; and a controller determining whether the defrosting liquid supplied from the storage tank is supplied or adjusting a supply amount of defrosting liquid on the basis of the time integrated by the timer.

In accordance with another embodiment, a method for controlling an outdoor unit in which a defrosting operation is selectively performed during a heat operation in the outdoor unit including an outdoor heat exchanger, the method including: detecting a temperature of an outlet of the outdoor heat exchanger; comparing the temperature of the outlet to a set temperature to determine whether the defrosting operation is performed; injecting a defrosting liquid to the outdoor heat exchanger according to a set time period during the defrosting operation; and finishing the defrosting operation when the supply number of defrosting liquid reaches a set number.

In accordance with another embodiment, an outdoor unit for an air conditioning system comprises a tank to store defrosting liquid; a nozzle to apply defrosting liquid from the tank to a heat exchanger; a valve to control flow of the defrosting liquid between the tank and nozzle; and a controller to control the valve based on a temperature of the heat exchanger and a number of times the valve has been set to an open state during a heating mode of the air conditioning system.

The controller may control the number of times the valve is set to the open state based on a comparison of the temperature of the heat exchanger to at least one predetermined temperature range. The controller may control valve to be open a first number of times when the temperature is in a first range and a second number of times when the temperature is in a second range different from the first range.

In addition, the controller may control the valve to be open for a first time period for each of the first number of times and controls the valve to be open for a second time period for each of the second number of times, where the first time period is different from the second time period. Also, the first range may be greater than the second range and the first time period may be less than the second time period.

In the first temperature range, the controller may control the valve to be in a second state for a period of time longer than the first period of time between the at least two of the first number of times. The second state may be a closed state or a state is between the open state and the closed state.

In the second temperature range, the controller may control the valve to be in the second state for the second period of time between said at least two of the second number of times.

The outdoor unit may also include a sensor to determine a level of the defrosting liquid in the tank, where the controller controls information to be displayed indicating the level of defrosting liquid in the tank. The displayed information may indicate that the tank needs to be refilled with defrosting liquid. Also, the temperature of the heat exchanger may correspond to a temperature of a surface of the heat exchanger or may correspond to a temperature of air in a space where the heat exchanger is located.

In accordance with another embodiment, an outdoor unit for an air conditioning system comprises a first tank; a container to collect defrosting liquid from a heat exchanger; a pump to move the defrosting liquid from the container to the first tank; and a controller to control flow of defrosting liquid from the first tank to the heat exchanger based on a temperature of the heat exchanger in heating mode of the air conditioning system.

In addition, the outdoor unit may include a second tank to store supplemental defrosting liquid; a sensor to determine a concentration of defrosting liquid in the container after the defrosting liquid has been diluted with water from melted frost. The controller may control supplemental defrosting liquid in the second tank to flow into the first tank based on the concentration of defrosting liquid determined by the first sensor.

In addition, the outdoor unit may include a sensor to determine a level of fluid which includes the defrosting liquid in the container, wherein the controller controls the pump to move defrosting liquid from the container to the first tank based on the level determined by the sensor.

In addition, the outdoor unit may include a valve to control the flow of defrosting liquid from the first tank. The controller may control the valve based on the temperature of the heat exchanger and a number of times the valve has been set to an open state during the heating mode of the air conditioning system.

The controller may control the number of times the valve is set to the open state based on a comparison of the temperature of the heat exchanger to at least one predetermined temperature range. The controller may control the valve to be open a first number of times when the temperature is in a first range and a second number of times when the temperature is in a second range different from the first range.

In addition, the controller may control the valve to be open for a first time period for each of the first number of times and controls the valve to be open for a second time period for each of the second number of times, and wherein the first time period is different from the second time period. The first range may be greater than the second range, and the first time period may be less than the second time period.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of one embodiment may be combined with the features of one or more of the other embodiments.

Although embodiments have been described with reference to a number of illustrative embodiments, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device for an air conditioning system, comprising:

a tank to store defrosting liquid;

a nozzle to apply defrosting liquid from the tank to a heat exchanger;

a valve to control flow of the defrosting liquid between the tank and nozzle;

a defrosting liquid tray to collect the defrosting liquid passing through the heat exchanger;

a concentration sensor provided in the defrosting liquid tray to detect a concentration of the collected defrosting liquid;

a defrosting liquid level sensor in the defrosting liquid tray to detect a liquid level of the collected defrosting liquid;

a supplement defrosting liquid tank to selectively supply supplement defrosting liquid to the tank;

a supplemental liquid valve having an adjustable opening degree to supply the supplement liquid into the tank from the supplement liquid tank; and a controller to control the valve based on a temperature of the heat exchanger and a number of times the valve has been set to an open state during a heating mode of the air conditioning system, wherein the controller determines an amount required to fill the tank with the supplement defrosting liquid from the supplement defrosting liquid tank, on the basis of a concentration of a collected defrosting liquid detected by the concentration sensor, wherein the controller adjusts an opening degree of the supplement liquid valve when the concentration of the defrosting liquid detected by the concentration sensor is less than a predetermined concentration, and wherein the controller operates the pump to pump the defrosting liquid into the tank from the defrosting liquid tray, which is provided at a position lower than a position of the tank, when a liquid level of the defrosting liquid detected by the defrosting liquid level sensor is greater than a predetermined liquid level.

2. The outdoor device of claim 1, wherein the controller controls the number of times the valve is set to the open state based on a comparison of the temperature of the heat exchanger to at least one predetermined temperature range.

3. The outdoor device of claim 2, wherein the controller controls the valve to be open a first number of times when the temperature is in a first range, and a second number of times when the temperature is in a second range different from the first range.

4. The outdoor device of claim 3, wherein the controller controls the valve to be open for a first time period for each of the first number of times and controls the valve to be open for a second time period for each of the second number of times, and wherein the first time period is different from the second time period.

5. The outdoor device of claim 4, wherein a temperature of the first range is greater than a temperature of the second range, and the first time period is less than the second time period.

6. The outdoor device of claim 5, wherein in the first temperature range the controller controls the valve to be in a second state for a period of time longer than the first period of time between the at least two of the first number of times.

7. The outdoor device of claim 6, wherein the second state is a closed state.

8. The outdoor device of claim 6, wherein the second state is between a fully open state and a fully closed state.

9. The outdoor device of claim 6, wherein in the second temperature range the controller controls the valve to be in the second state for the second period of time between the at least two of the second number of times.

10. The outdoor device of claim 1, wherein the controller controls information to be displayed indicating the level of defrosting liquid in the tank.

11. The outdoor device, of claim 10, wherein the displayed information indicates that the tank needs to be refilled with defrosting liquid.

12. The outdoor device of claim 1, wherein the temperature of the heat exchanger corresponds to a temperature of a surface of the heat exchanger or a temperature of air in a space in which the beat exchanger is located.

* * * * *